US005194007A

United States Patent [19]

Marshall et al.

[11] Patent Number: 5,194,007

[45] Date of Patent: Mar. 16, 1993

[54] SEMICONDUCTOR LASER WEAPON TRAINER AND TARGET DESIGNATOR FOR LIVE FIRE

[75] Inventors: Albert H. Marshall, Orlando; Ronald S. Wolff, Cocoa, both of Fla.

[73] Assignee: The United States of America as represented by the Secretary of the Navy, Washington, D.C.

[21] Appl. No.: 703,322

[22] Filed: May 20, 1991

[51] Int. Cl.[5] ..... F41G 3/26

[52] U.S. Cl. ..... 434/21; 434/11; 434/19; 273/311; 372/38; 33/233

[58] Field of Search ..... 434/11, 14, 15, 19-23, 434/27; 273/310-313, 316; 372/38; 33/227, 233

[56] References Cited

U.S. PATENT DOCUMENTS

| | | | |
|---|---|---|---|
| 3,633,285 | 1/1972 | Sensney | 273/310 X |
| 3,748,751 | 7/1973 | Breglia et al. | 434/21 |
| 3,995,376 | 12/1976 | Kimble et al. | 434/22 |
| 4,317,652 | 3/1982 | Marshall et al. | 434/22 |
| 4,487,583 | 11/1984 | Brucker et al. | 434/22 |
| 4,553,943 | 11/1985 | Ahola et al. | 434/22 |
| 4,592,730 | 6/1986 | Knight et al. | 434/22 |
| 4,640,514 | 2/1987 | Myllylä et al. | 273/310 |
| 4,662,845 | 5/1987 | Gallagher et al. | 434/22 |
| 4,678,437 | 7/1987 | Scott et al. | 434/21 |
| 4,768,958 | 9/1988 | Suddaby | 434/21 |
| 4,811,955 | 3/1989 | DeBernardini | 273/310 |

*Primary Examiner*—Richard J. Apley
*Assistant Examiner*—Joe H. Cheng
*Attorney, Agent, or Firm*—Robert W. Adams

[57] ABSTRACT

Disclosed is a capability for training and other uses wherein a firearm can be aligned with its target by use of a laser beam, or the target can be designated to others by illuminating it with the laser beam. A laser diode that provides visible light is used in conjunction with the boresight of a gun to paint a visible spot on an intended target at the location the bullet will impact if the weapon were fired. The beam emitted by the diode is collimated by a miniature gradient refractive index lens co-located with the diode on a heat sink that is included to convey heat away from the heat sensitive components. A circuit having a photodiode and a differencing amplifier is included to provide stability in the output of the laser, in order to overcome the effects of thermal excursions, and to protect the reflective surfaces of the laser from power surges. The on-off switch is a pressure sensitive material removably attached to the gun in a convenient location for it to be operated by the user's gun hand.

6 Claims, 2 Drawing Sheets

SEMICONDUCTOR LASER WEAPON TRAINER AND TARGET DESIGNATOR FOR LIVE FIRE

BACKGROUND OF THE INVENTION

The present invention relates generally to the field of training devices, and more specifically to firearm-related multi-purpose embedded devices that are useful in an operational role.

Today it is imperative that uniformed personnel be proficient in small arms skills to protect both military and civilian assets. Many trainees are spending considerable time dry firing the weapon they are assigned, and repetitively are snapping-in a proposed target to develop muscle memory and practice habits that will become routine before a real need occurs to fire the weapon. Precision shooting particularly is important when rapid accurate firing is necessary, such as in a hostage situation.

Target illuminators have been designed previously by others for use with simulated firearms and with operational firearms dedicated to a simulation mode. They include U.S. Pat. No. 4,811,955 which discloses a dummy firearm that has a laser tube in lieu of a barrel, an electronic package concealed in a simulated handgrip, a high-voltage power supply, and an adjustable trigger. Also, U.S. Pat. No. 4,768,958 discloses an alignment plug for mounting a laser beam projector assembly having a mandrel which is inserted into the muzzle end of a functioning weapon to detect the discharge of dummy round. A window in the plug permits the flash from the dummy round to be detected and trigger the coded laser. U.S. Pat. No. 4,678,437 discloses a substitute cartridge that when triggered emits radiation from a light emitting diode, instead of a bullet. U.S. Pat. No. 4,662,845 discloses a target system for responding to laser beams coded to be separately identifiable from each of a plurality of rifles. The laser is on the rifle and is driven by a weapon code generator to produce one or more coded optical pulses. U.S. Pat. No. 4,640,514 discloses another apparatus in which a mandrel is inserted into the muzzle of a gun, U.S. Pat. No. 4,553,943 discloses another laser on a rifle for illuminating a detector-target with invisible light, and U.S. Pat. No. 4,487,583 discloses a vest that is responsive to a pistol that fires laser beams instead of bullets.

SUMMARY OF THE INVENTION

An object of the present invention is to provide for training and live-fire situations a light-weight attachment to a sidearm that will pinpoint a target with visible light and permit the sidearm to be used as a target designator. Since the attachment projects a collimated laser beam in a predictable relationship to the boresight of the sidearm without obstructing it, the pinpoint of visible light can be made to appear on the target where a bullet will impact when the sidearm is fired. The small spot of visible light also serves to designate the target to other team members.

Another object is to employ a semiconductor laser as the light emitting source along with a gradient refractive index lens to collimate the laser's light. Both are mounted on a small heat sink.

Another object is to provide an automatic power control circuit to stabilize the output of the laser diode with electrical feedback that offsets the affects of thermal buildup, wherein the circuit is designed to be powered by a compact low-voltage battery.

Another object is to provide the apparatus with a pressure-sensitive switch that is convenient to the gun hand of the user such that the laser diode can be turned on for a short period of time just before the target is to be fired on.

Another object is to provide a low-cost, rugged, small, battery operated apparatus for teaching sight picture as well as for target assault and designation in live-fire application.

Another object is to provide a micropower control system to maintain the laser at a constant output to both protect the laser and maintain a constant optical visibility, provide an optical collimation system for the laser beam, and provide a weapon fire trainer and a live-fire target designator that is/are small and lightweight, waterproof, very rugged and consume(s) little power.

Another object of the present invention is to provide a light weight attachment for use with firearms, especially sidearms, that will not obstruct or diminish the operator's use of the firearm in any way; but, instead will enhance the capabilities of the weapon by increasing its uses, and will improve the operator's effectiveness in using the firearm in its conventional manner to hit the intended target. The invention achieves its objective by proposing that a structure having a package of components comprising a battery operated laser diode, collimating optics and power-regulating electronic circuitry, be removably attachable under the barrel of the firearm in a predictable relationship with the boresight of the weapon. The visible light provided by the laser diode serves both to illuminate before the weapon is fired the point of impact of its bullet, as well as designate for others, in a separate use of the invention, a proposed target to be fired at by the operator's of other weapons. As a training device without ammunition it is useful alone to perfect the user's aiming skills, and in conjunction with laser detectors to develop team oriented interactive combative techniques. The laser is operated by the application of pressure to a thin-film switch attached to the firearm at a convenient location to the user's trigger finger or gun hand.

The invention contemplates the inclusion of surge suppression circuitry to prevent overpowering the laser diode and causing optical damage to its reflective surfaces; and, automatic gain control feedback circuitry to maintain the light power output of the laser diode substantially constant regardless of its thermal shift due to operational heating. Also, a heat sink is used as the mount on which the diode and optics are placed to further diminish heat build-up in the operating components. For convenience, the circuitry is designed to operate on a conventional nine-volt portable power source that is conveniently available, lightweight and easily replaceable by the user.

DESCRIPTION OF A PREFERRED EMBODIMENT

Figure 1:
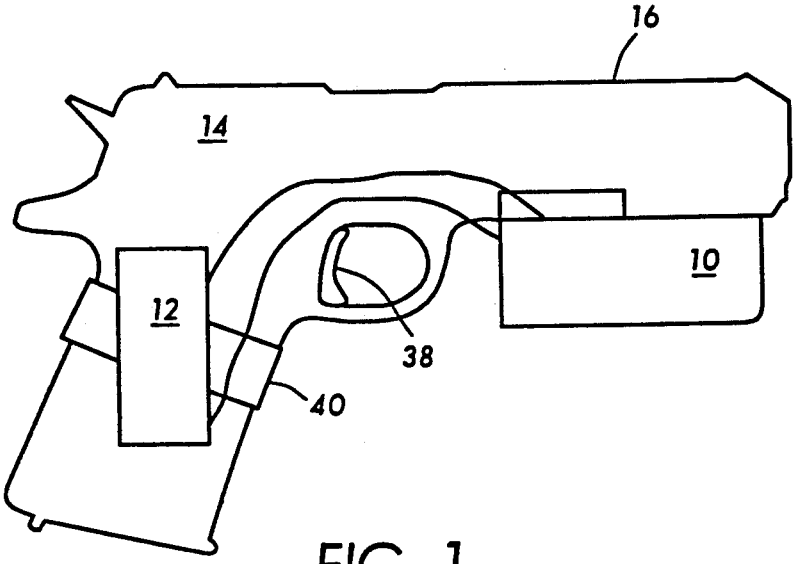
FIG. 1 is an illustration depicting the apparatus attached to a handgun.

FIG. 1 shows the invention attached to a handgun. The apparatus of the invention is packaged in housing 10 with external switch 12. Like numerals represent the same components throughout the Figs.

Handgun 14 is representative of the weapons on which the present invention may be used to its full advantage. Due to its lightweight the invented apparatus is especially suitable for relative lightweight guns such as sidearms, even though the invention can be used alone for training and as a target designator, and with other weapons such as rifles. Housing 10 is mounted to handgun 14 preferably by removable attachment. One such attachment is to adapt a suitable fixture such as a slot and bayonet mount with one part affixed to handgun 14 and the other part affixed to housing 10. Another, is to shape housing 10 to mold into the body of handgun 14 such that the apparatus is not easily dislodged from its position when it is retained by a strap snugly wrapped around barrel 16 and affixed to or around housing 10. Another, is to fashion a flange and threadable means for securing housing 10 to the underside of barrel 16. The attachment is to direct the forward looking laser beam that emerges from housing 10, in a predictable relationship to the boresight of handgun 14 so that the collimated straight-line beam and a bullet from the muzzle of the handgun will be coincident at a given target under the presupposed conditions. Thereby, the user of the handgun can see on the target a spot of visible light from the laser that assuredly denotes the bullet's sure-fire point of impact.

Figure 2:
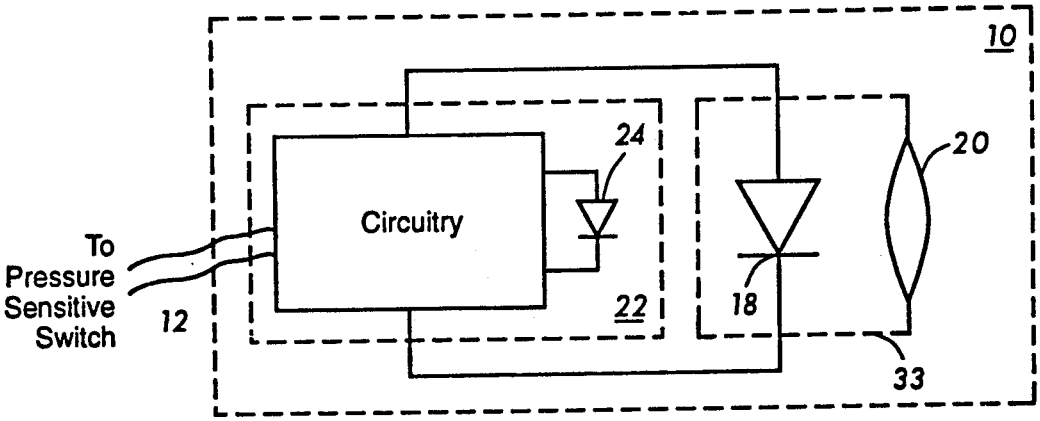
FIG. 2 is a block diagram of the apparatus, partially in schematic and illustrative form, depicting the arrangement of components assembled for attachment to a handgun; and, FIG. 3 is a schematic diagram of the power-control circuit of the invention.
Figure 3:
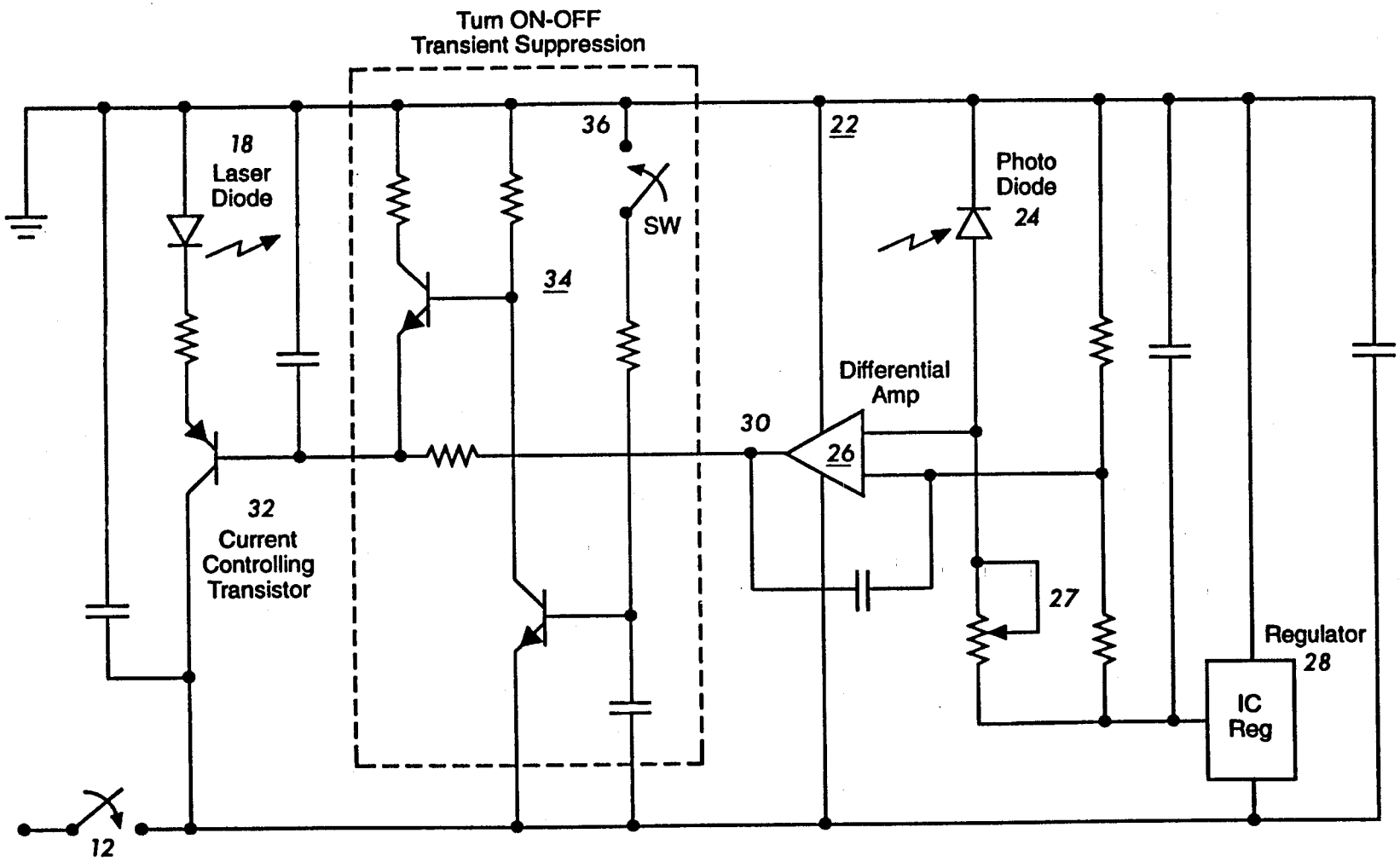

The laser beam is emitted by laser diode 18, shown in FIG. 2 and FIG. 3. It is an AlGaInP double heterostructure visible laser diode. Typically the peak emission wavelength of the laser is 670 nm, and the maximum output is 3 to 10 milliwatts. An available diode that emits at that wavelength is model NDL 3200 from NEC. It provides at 25 degrees Centigrade an absolute optical output power maximum of 4.0 mW, with a life expectancy in excess of three-thousand hours. The output power of the laser diode is very temperature-dependent and will decrease significantly as its temperature increases unless the driving current provided to it is adjusted. The laser's output light is an elliptical-shaped visible beam with a vertical beam angle of 35 degrees and a lateral beam angle of 7 degrees.

Collimation of the beam from diode 18 is achieved by lens 20. It is very small, has a diameter of 3.0 mm and a focal length of 3.72 mm. The lens selected for the preferred embodiment is a SELFOC gradient refractive index lens designed by NSG America Incorporated for use with 780 nm laser diodes. The lens has a minimum transmittance of 97% with a C-grade anti-reflective coating. Testing by the inventors has determined that despite the difference between the wavelength provided by the selected laser diode and the wavelength designed for the lens, the collimation achieved by using them in combination in accordance with the present invention is excellent.

Since the optical output power of laser diodes varies as a function of temperature, its output power will fluctuate as its temperature changes if it is driven with a constant electrical current. For example, if the power output of the laser diode is 3 mW when it is driven with a current of 60 mA at 15 degrees Centigrade, when its temperature increases to 45 degrees Centigrade a driving current of 80 mA would be necessary to maintain the power output at 3 mW.

To compensate for the inherent characteristics of laser diode 18, the invention includes circuit 22 having photodiode 24. The circuit is an automatic power control circuit that is intended to be powered by a common 9 volt transistor radio type battery. Circuit 22 senses the output power of laser diode 18 by using PIN photodiode 24 that is packaged with laser diode 18 as a unit. Difference amplifier 26 compares the output of PIN photodiode 24 to a reference voltage that is calibrated at room temperature by adjusting control 27, and stabilized as shown by regulator 28 in FIG. 3. Output 30 provides a signal that can adjust transistor 32, which in turn can vary the driving current through laser diode 18. By controlling the current through laser diode 18, the power in the laser beam can be maintained at a constant output level. Thereby, the beam's intensity can be sustained at a constant level and its appearance on the target can be made to remain unchanged. In addition, the consequences of heat are retarded by mounting both laser diode 18 and lens 20 on heat sink 33 to dissipate some of the heat generated during operation of the laser before the heat has an opportunity to cause the laser's temperature to rise.

Also, circuit 22 provides surge protection by including transient suppression circuitry 34. Just as circuitry within a house is susceptible to damage from lightning induced power surges, laser diodes can be damaged by surges within their electronic circuitry. A surge on a laser diode chip can ruin the lasing action of the diode by damaging its mirror facets and destroying or diminishing their reflective characteristics. Suppression circuitry 34 inhibits surges in output 30 of amplifier 26 that would prove damaging to laser diode 18. On-off switch 36 is included to effectively remove suppression circuitry 34 from circuit 22, if desired. When switch 36 is open the switch is off and circuitry 34 is not operational to suppress surges in output 30 of amplifier 26.

Switch 12 operates to connect and disconnect the battery power source (not shown) of circuit 22. Inasmuch as often it is desirable to illuminate the target with the laser beam only for a short period of time, in order to prolong the battery's life or minimize the target's ability to react, the preferred embodiment contemplates placement of switch 12 under the user's trigger finger or gun hand. FIG. 1 shows switch 12 on the handle of gun 14. For a right handed user, switch 12 as shown would be under his palm. For a left handed user, switch 12 as shown would be under his finger tips. Of course, the opposite would be the case if switch 12 were placed on the opposite side of the handle that is out of view in FIG. 1. As an alternative, switch 12 could be placed on trigger 38. In whichever location is chosen, it is preferred that switch 12 be of a type that is sensitive to the application of pressure. It is intended that the user would apply pressure with his fingers either on the handle or the trigger that is sufficient to close switch 12 and illuminate the target, before enough force is applied to trigger 38 to fire gun 14. Accordingly, if switch 12 is attached to trigger 38 the switch must be selected or manufactured to be responsive to less force than is required to fire gun 14; and, if switch 12 is attached to the handle, the switch should be selected to be responsive to a comfortable application of pressure by the user without degrading his ability to accurately aim the weapon and fire it, if firing the weapon is intended.

Switch 12 may be attached to the firearm by suitable means, such as by adhesive or threaded means. For ease of removal, switch 12 is affixed in the preferred embodiment by VELCRO, such as by strap 40 that encircles the handle in FIG. 1.

Briefly, the preferred embodiment operates as follows: Initially, the output of laser diode 18 is adjusted at room temperature by setting control 27. When pressure is applied to switch 12, it closes and connects the battery (not shown) to power-up laser diode 18. When power is applied to circuit 22, regulator 28 maintains the reference voltage to differential amplifier 26 at a constant value. Heat sink 33 dissipates heat generated by laser 18. However, as the temperature of laser diode 18 rises its output power would degrade were it not for the compensating current provided by circuit 22. The laser output of diode 18 is monitored by photodiode 24 which is coupled to an input of differential amplifier 26. Differential amplifier 26 compares the input from photodiode 24 to the above-identified reference voltage and provides output 30 to transistor 32. When output 30 responds to a change in photodiode 24, transistor 32 begins to adjust the current passing through laser diode 18 to bring the output power of the laser back to its initial level. Thereby, circuit 22 with photodiode 24, differential amplifier 26 and transistor 32, forms a feedback circuit to laser diode 18 that stabilizes the laser's output beam and overcomes its response to thermal affects.

From the foregoing description, it may readily be seen that the present invention comprises a new, unique and exceedingly useful device which constitutes a considerable improvement over the prior art. Obviously, many modifications and variations of the present invention are possible in light of the above teachings. It is, therefore, to be understood that within the scope of the appended claims the present invention may be practiced otherwise than as specifically described.

What is claimed is:

1. Apparatus adapted for use in conjunction with an operational firearm having a bore, handle and trigger to both expand on the capabilities of the firearm and enhance the operator's effectiveness when the firearm is used as a weapon, wherein the apparatus provides a narrow column of visible light that can be used to illuminate the spot that the firearm's bullet will hit if the firearm is fired, and can be used to illuminate and thereby designate a proposed target for other weapons to be fired at by their operators, comprising;

a heat sink;

a laser diode source of visible light having a beam with a cross-section that is elliptical in shape, mounted on said heat sink;

optical means fixedly placed in the path of said light to collimate said beam, having a gradient refractive index lens mounted on said heat sink;

means adapted for removably attaching said source of visible light and said optical means to said firearm such that said collimated beam has a predictable relationship to the boresight of the firearm; and, circuitry means coupled to said source of visible light for powering said laser diode and automatically adjusting the driving current to the laser diode to maintain its output of light substantially constant;

wherein said circuitry means includes a photodiode fixedly mounted adjacent said source of visible light to detect light from said laser diode and provide an output responsive thereto.

2. The apparatus of claim 1 wherein said circuitry means further includes a source of stable electrical voltage, differencing amplifier means electrically coupled to said photodiode and said voltage source for comparing the output of said photodiode to said stable voltage and producing a control signal to equalize the output of said photodiode to said stable voltage by adjusting the current through said laser diode and thereby its light output.

3. The apparatus of claim 2 wherein said circuitry means includes means for providing surge protection to said laser diode.

4. The apparatus of claim 3 wherein said laser diode, said optical means and said circuitry means are mounted together in a self-contained lightweight structure that is shaped to snugly fit the contour of said firearm, and said structure is attached to said firearm by said means adapted for removably attaching said source of visible light, wherein said means adapted for removably attaching said source of visible light is two straps of interlocking fabric having one end of each strap welded to said structure and the other end of each strap free to be tightly drawn around said firearm and interlocked together.

5. The apparatus of claim 3 wherein said circuitry further includes remote pressure-sensitive switch means for activating said laser diode, removably attached to said trigger of said firearm and operable by less pressure than the pressure required to trigger said firearm.

6. The apparatus of claim 3 wherein said circuitry further includes remote pressure-sensitive switch means for activating said laser diode, removeably attached to said handle of said firearm.

* * * * *